United States Patent [19]

Ochiai et al.

[11] 4,203,215

[45] May 20, 1980

[54] ENDLESS CHAIN FOR A CHAIN SAW

[75] Inventors: Hiroyoshi Ochiai, Miyazaki; Masao Nakamoto, Fukuoka, both of Japan

[73] Assignee: Hideaki Taniguchi, Miyazaki, Japan

[21] Appl. No.: 916,618

[22] Filed: Jun. 19, 1978

[30] Foreign Application Priority Data

Jul. 8, 1977 [JP] Japan ..... 52-91327[U]

[51] Int. Cl.[2] ..... B27B 17/02; B27B 33/14

[52] U.S. Cl. ..... 30/383; 83/838

[58] Field of Search ..... 30/381, 383, 384, 385, 30/386, 387; 83/835, 838

[56] References Cited

U.S. PATENT DOCUMENTS

| | | | |
|---|---|---|---|
| 2,855,724 | 10/1958 | Graves | 30/381 X |
| 2,924,254 | 2/1960 | Smith | 30/383 |
| 3,360,022 | 12/1967 | Stihl | 83/838 |
| 3,938,417 | 2/1976 | Nedsten | 83/835 |

FOREIGN PATENT DOCUMENTS

| | | | |
|---|---|---|---|
| 294302 | of 1971 | U.S.S.R. | 83/838 |

*Primary Examiner*—Jimmy C. Peters

*Attorney, Agent, or Firm*—Jordan and Hamburg

[57] ABSTRACT

An endless chain of this invention for a chain saw is provided with cutter links of a unique shape and construction. Such cutter link has an inclined U-shaped and substantially consists of a saw adjusting portion and a saw tooth portion. The saw tooth portion further has a hard metal tip brazed at the top thereof, wherein the hard metal tip forms a saw set. Due to such construction, the saw tooth portion which is provided with such hard metal tip can smoothly saw off lumber while the saw adjusting portion can completely remove the sawn-off lumber chips. The saw adjusting portion also provides minimum vibration of the chain saw.

7 Claims, 5 Drawing Figures

ENDLESS CHAIN FOR A CHAIN SAW

BACKGROUND OF THE INVENTION

This invention relates to an endless chain used for a chain saw, and more particularly to an improved type of cutter links which form the endless chain.

In the last decade, there has been a remarkable improvement in the chain saw industry. One of the most developed types of chain saws has the endless chain which uses cutter links of a P-shaped cross-section.

In the sawing operation by the above endless chain, the endless chain "cuts off" lumber.

In general, however, the "cutting off" requires a considerably greater cutting force compared with the "sawing off".

Such conventional chain saw is also provided with cutter teeth at long intervals along the endless chain so that the endless chain must be rotated at an extremely high speed necessitating a large-sized drive mechanism. The use of such large-sized drive mechanism inevitably increases the weight of the chain saw. Furthermore, such "cutting off" operation, in general, causes severe vibration so that woodcutters often suffer from "white hand" disease.

It is an object of the present invention to provide an improved-type of endless chain which can "saw off" lumber and accordingly can overcome the afore-mentioned defects of the conventional chain saw.

It is another object of the present invention to provide improved type of cutter links which can smoothly saw off lumber with minimum vibration of the chain saw.

DETAILED DESCRIPTION OF THE DISCLOSURE

Figure 1:
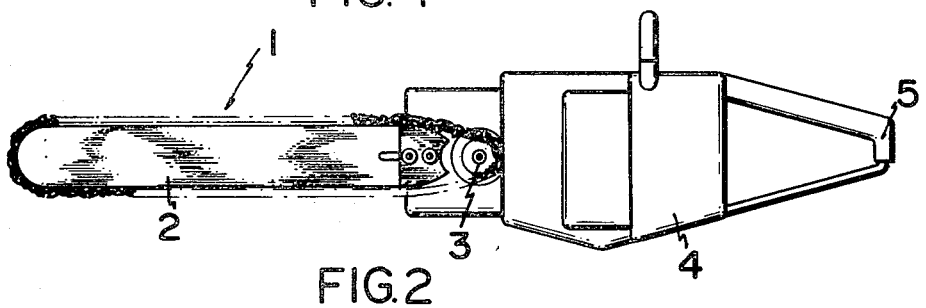
FIG. 1 is a side view of a chain saw provided with an endless chain of the present invention.
Figure 2:
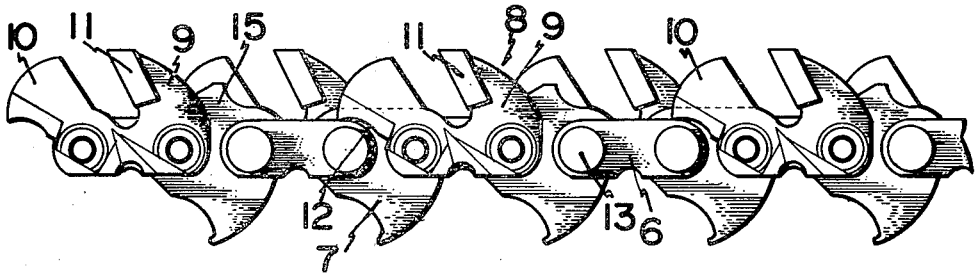
FIG. 2 is a partial side view of the above endless chain.

In FIG. 1, a chain saw equipped with an endless chain 1 of this invention is shown, wherein the endless chain 1 is wound and is slidable along the periphery of a guide plate 2.

One end of the endless chain 1 is engaged with a sprocket wheel 3 which, upon rotation, imparts the slide movement to the endless chain 1. Numeral 4 indicates a drive mechanismm which is actuated so as to rotate the sprocket wheel 3. Such drive mechanism includes a handle 5 attached thereto.

Figure 3:
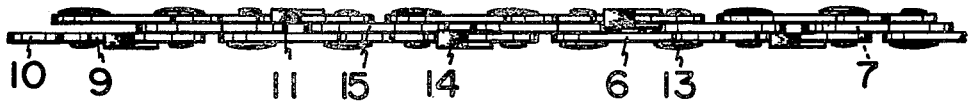
FIG. 3 is a plan view of the above endless chain.

The endless chain 1 is basically made by connecting joint links 6 and sprocket teeth links 7 alternately, wherein the teeth links 7 engage with the teeth of the sprocket wheel 3. In case other drive means instead of the sprocket wheel 4 is employed, teeth links may be unnecessary. A cutter link 8 is provided at one side of each sprocket teeth link 7 in alignment with the joint link 6 such that the cutter link 8 and the joint link 6 sandwich the sprocket teeth link 7 therebetween. In each consecutive link of the chain, the joint link and the cutter link alternate positions, thus forming a zig-zag pattern as can be seen in FIG. 3.

Each cutter link 8 is made of a saw tooth portion 9 and a saw adjusting portion 10. A hard metal tip 11 is secured (preferably by brazing) to the top of the saw tooth portion 9 such that the top of the hard metal tip 11 inclines toward a cutting direction. Such hard metal tip 11 forms a cutting edge of the cutter link 8. If desired, the cutting edge can be formed by the same material as that of the cutter link 8. In the above construction, the saw tooth portion 9 provided with such hard metal tip 11 saw off the lumber while the saw adjusting portion 10 decreases the vibration of the endless chain 1 and removes the lumber chips prior to the sawing off by the saw tooth portion 9.

The hard metal tip 11 has a width greater than that of the saw tooth portion 9 and the difference of width extends outwardly from the outer side of the saw tooth portion 9 to form a "saw set". Furthermore, the top of the hard metal tip 11 is positioned slightly higher than the top of the sawing adjusting portion 10. The hard metal tip 11 can take any shape corresponding to the kind of lumber to be cut. The sawing adjusting portion 10 has a recess 12 formed to the lower portion thereof which engages or rests on the semi-circular rear end of the joint link 6.

Referring to other parts of the above endless chain 1, a joint pin 13 rotatably connects the joint link 6, the sprocket teeth link 7 and the cutter link 8. Numeral 14 indicates an intermediate cutter link. This cutter link 14 is provided with a hard metal tip 11' which extends in both lateral directions from the sides of the saw tooth portion 9' to form a saw set at each side of the saw tooth portion 9'.

Figure 4:
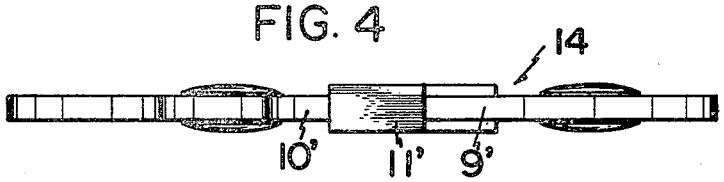
FIG. 4 is a plan view of an intermediate cutter link of this invention.

Due to such construction (FIG. 4), the intermediate cutter link 14 can saw off the intermediate band or range of the sawing path of the lumber which cannot be sawn off by the afore-mentioned cutter links 8 which have saw sets only at the outward side. Numeral 15 indicates a protrusion which is formed to the top of the sprocket teeth link 7. This protrusion 7 facilitates the removal of the sawn-off chips.

As we have discussed above, the hard metal tip 11 has the top thereof positioned slightly higher than the top of the sawing adjusting portion 10. The cutting depth is adjustable by preferably determining the above difference in height.

Furthermore, since the rear end of the joint link 6 supports the sawing adjusting portion 10 in an upward direction, the endless chain 1 can maintain the above cutting depth throughout the sawing operation.

The manner in which the chain saw provided with the endless chain 1 of this invention is operated is hereinafter disclosed.

Along with the activation of the drive mechanism 4, the sprocket wheel 3 starts the rotation thereof and simultaneously the endless chain 1 starts the slide movement along the periphery of the guide plate 2. When the endless chain 1 under the slide movement comes into contact with the desired portion of lumber (or a tree) to be cut, the cutter links 8, which are provided with hard metal tips 11, smoothly cut into the lumber in a direction toward the center or core of the lumber and simultaneously the intermediate cutter links 14 saw off the central zone of the cutting path. After these cutter links 8, 14 saw off, the sawing adjusting portions 10 and the protrusions 15 follow the above sawing operation and remove the sawn-off lumber chips. It must be also noted that such saw adjusting portions 10 assure the smooth sawing operation of the endless chain 1 while restricting the vibration of the chain saw as small as possible.

In this way, the sawing-off operation and the operation to remove the sawn-off lumber chips can be simultaneously conducted. Furthermore, since the hard metal tips 11, 11' show the highly improved cutting performance compared with conventional cutting teeth, the cutter links of this invention can efficently saw-off the lumber while restricting the occurence of vibration.

Stiff furthermore, since the saw sets are formed by hard metal tips 11, 11', the cutter links 8 can withstand a sawing operation of a considerably long period, namely until such hard metal tips 11, 11' of high abrasion-resistance wear. Therefore, it is no longer necessary to replace the cutter links 8 as frequently as before.

Figure 5:
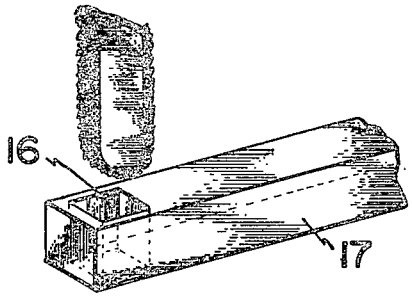
FIG. 5 is a modification having a plurality of chains for cutting a mortice in a beam.

FIG. 5 shows the modification of the endless chain of this invention wherein a plurality of endless chains of this invention are laterally connected and thus connected chains are available for cutting a mortice 16 in a beam 17.

As has been described heretofore, the endless chain 1 of the present invention has the following advantages.

1. Since the endless chain 1 of this invention "saws off" the lumber (not cutting off), the endless chain 1 can restrict the occurrence of vibration to a minimum level.
2. The saw set can be readily formed by merely securing (brazing) the hard metal tip 11, 11' to the top of the sawing teeth portion 9, 9'. Furthermore, the formation of the saw set by the hard metal tip 11, 11' can maintain the saw set until the hard metal tip 11, 11' wears completely, thereby the replacement of the cutter links 8 can be drastically decreased in number.
3. Since the pitch between the cutter links 8 can be made as narrow as possible, the slide speed of the endless chain 1 which slides along the periphery of the guide plate 2 can be lowered resulting in a drive mechanisms of small output power and a small-sized chain saw.

What we claim is:

1. In an endless chain for a chain saw comprising a plurality of pivotally connected cutter links, joint links and sprocket teeth links, the improvement wherein:

(a) the cutter link has a saw adjusting portion forming a first inclined section and a saw tooth portion forming a second inclined section, said saw adjusting portion and said saw tooth portion being integrally joined to form an inclined U-shape construction, (b) a cutting edge provided at the top of said saw tooth portion, (c) said saw adjusting portion having a lower edge section, and means defining a recess formed in said lower edge section, (d) said joint link having a forward and a rear end portion, said rear end portion having a semi-circular configuration, (e) said cutter link and said joint link being disposed such that said recess in said cutter link engages said semi-circular rear end portion of said joint link to thereby support said cutter link on said joint link.

2. In an endless chain according to claim 1 wherein said cutting edge is formed by a hard metal tip secured to the top of said saw tooth portion.

3. In an endless chain according to claim 2 wherein said hard metal tip has a width greater than that of said saw tooth portion forming at least one saw set as determined by the difference of said two widths.

4. In an endless chain according to claim 3 wherein said hard metal tip extends laterally outwardly from the outward side of said saw tooth portion forming said saw set at the outward side of said saw tooth portion.

5. In an endless chain according to claim 3, wherein said hard metal tip extends laterally outwardly and inwardly from both sides of said saw tooth portion forming said saw sets at both sides of said saw tooth portion.

6. In an endless chain according to claim 1 wherein joint pins are provided to pivotally interconnect said cutter links, joint links and sprocket teeth links, said sprocket teeth links being sandwiched between said cutter links and said joint links.

7. In an endless chain according to claim 1 wherein said sprocket teeth links have a top protrusion to facilitate removal of chips.

* * * * *